United States Patent [19]

Stahlecker

[11] Patent Number: 4,656,826

[45] Date of Patent: Apr. 14, 1987

[54] APPARATUS FOR OPEN-END FRICTION SPINNING

[75] Inventor: Fritz Stahlecker, Bad Überkingen, Fed. Rep. of Germany

[73] Assignee: Hans Stahlecker, Suessen, Fed. Rep. of Germany

[21] Appl. No.: 761,684

[22] Filed: Aug. 2, 1985

[30] Foreign Application Priority Data

Aug. 3, 1984 [DE] Fed. Rep. of Germany ..... 3428705

[51] Int. Cl.[4] ..... D01H 1/135; D01H 13/04

[52] U.S. Cl. ..... 57/401; 57/352; 57/417

[58] Field of Search ..... 57/401, 408, 411, 417, 57/352

[56] References Cited

U.S. PATENT DOCUMENTS 4,315,398 2/1982 Parker et al. ..... 57/401
4,485,618 12/1984 Anzinger ..... 57/401 X
4,497,168 2/1985 Kamp ..... 57/401
4,541,232 9/1985 Raasch ..... 57/401 X
4,541,233 9/1985 Raasch et al. ..... 57/401 X

FOREIGN PATENT DOCUMENTS 62404 10/1982 European Pat. Off. .

*Primary Examiner*—John Petrakes
*Attorney, Agent, or Firm*—Barnes & Thornburg

[57] ABSTRACT

A device is provided for open-end friction spinning having two adjacently arranged rollers serving to form a yarn forming wedge-shaped gap. The rollers are disposed in essentially a vertical direction. A supply of fibers is directed through a fiber feed channel extending at a sharp angle from underneath the rollers to the wedge-shaped gap. The withdrawal device for the spun yarn is disposed above the rollers. Between the wedge-shaped gap and the withdrawal device there is arranged a turning guide which first withdraws the yarn opposite the feeding direction in the longitudinal direction of the wedge-shaped gap and then turns the yarn and withdraws it to the withdrawal device disposed above.

30 Claims, 5 Drawing Figures

APPARATUS FOR OPEN-END FRICTION SPINNING

BACKGROUND AND SUMMARY OF THE INVENTION

The invention relates to an apparatus for open end friction spinning having two adjacently arranged friction rollers driven in the same rotational direction which define a yarn formation zone comprising a wedge-shaped gap. An inlet and opening device is provided for the fiber material to be spun including a fiber feed channel for feeding fibers to the wedge-shaped gap which is disposed at a sharp angle with respect to the gap. A withdrawal device for drawing the spun yarn in the longitudinal direction of the wedge-shaped gap and opposite the inlet direction of the fiber feed channel is provided.

With a known construction of the above mentioned kind (disclosed in European Patent Published Unexamined Application No. 0062404) both of the rollers are disposed horizontally adjacent one another so that the wedge-shaped gap formed thereby also extends horizontally. The inlet and opening device as well as the withdrawal device are disposed on the same side with respect to the end face of the rollers. With this known construction the individual elements are difficult to service because they are accessible only with great difficulty. This is true as well not only for the extending wedge-shaped gap which is difficult to observe, but also for the inlet and opening device and the withdrawal device which must be arranged in a very small space adjacent one another. This device is therefore also not suitable to accommodate servicing by means of an automatic traveling servicing device which, for example, carries out a start or piecing operation and/or a cleaning of the rollers, especially in the region of the wedge-shaped gap.

An object of the present invention is to construct an apparatus of the above mentioned kind wherein the individual elements are disposed in a serviceable and easily automated arrangement with respect to one another.

This object is attained in the provision of an apparatus having rollers that are arranged to extend essentially vertically. The inlet and opening device is arranged below the rollers and the withdrawal device is arranged above the rollers. Means for turning the yarn are first disposed to guide the yarn downwardly from the wedge-shaped gap and then back up to the withdrawal device.

This construction results, on the one hand, in a very compact construction arrangement. On the other hand, all of the elements for a servicing procedure are easily accessible and are also disposed for access by servicing devices of an automatic machine moving along the spinning machine.

In advantageous embodiments of the invention, it provided that the yarn forming position of the wedge-shaped gap is disposed at the servicing side of the spinning machine. This position is covered by means of a movable housing part which includes at least a part of the fiber feed channel. Thereby, the two rollers and also the region of the wedge-shaped gap can be exposed for a servicing process in a simple manner.

In order to accommodate different spinning conditions, it is provided according to the advantageous developments of the present invention that the means or mechanism for turning the yarn is adjustable in the direction of the plane of the wedge-shaped gap. The plane of the wedge shape gap extends through the gap is perpendicular to a plane passing through the area of rotation of the friction rollers. In this manner it can be assured that with different yarns, the yarn withdrawal is first in the direction of the wedge-shaped gap plane and then thereafter is turned. The turning of the yarn extension toward the withdrawal out of the wedge-shaped gap has further the advantage that thereby a twist block is created. The produced spinning twist in the yarn is thereby essentially reduced in the region between the wedge-shaped gap and the turning position in a controllable manner.

In further embodiments of the invention, it is provided that the first turning position at the connection with the wedge-shaped gap is formed by a turning roller. Advantageously the turning roller is provided with a guide groove for the yarn. With the help of this type of turning roller, it is possible to turn the yarn also laterally out of the wedge-shaped gap plane.

In advantageous embodiments of the invention, it is provided that a yarn guide channel connects to the turning roller. It is also advantageous that the yarn guide channel be adjustable in its inclination with respect to the wedge-shaped gap. Thereby, the effect of the blocking of the twist from the turning position can be controlled.

Other objects, advantages and novel features of the present invention will become apparent from the following detailed description of the invention when considered in conjunction with the accompanying drawings.

DETAILED DESCRIPTION OF THE DRAWINGS

Figure 2:
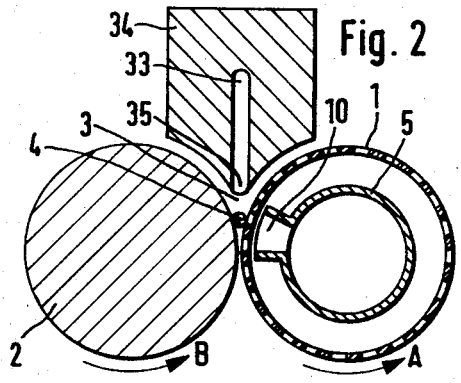
FIG. 2 is a sectional view through the device in the region of the rollers forming the yarn-forming wedge-shaped gap.

The apparatus illustrated in the drawings for open end friction spinning includes two rollers 1 and 2, the axes of which extend vertically. The two rollers 1 and 2 are spaced at small distance from one another and arranged in parallel forming a wedge-shaped gap 3 which comprises a yarn-formation zone for the formation of yarn 4. The two rollers 1 and 2 are disposed adjacent one another at the servicing side of the apparatus. The roller turning inwardly into the wedge-shaped gap 3 (arrow direction A, FIG. 2) is formed as a suction roller, while the roller 2 which rotates outwardly from the wedge-shaped gap (arrow direction B) is designed as a solid roller. It is to be understood that it is also possible to design both rollers 1 and 2 as suction rollers.

The cover surface of roller 1 designed as a suction roller is formed of a perforated shell which is directly supported on a suction pipe 5 by means of roller bearings 6 and 7. Suction roller 5 is closed at the upper end face 9 and extends with a curve 8 out of the bottom end face of the roller 1. The curved portion 8 is connected to a pressure course (not illustrated). Adjacent the region of perforations between the roller bearing 6 and 7, the suction pipe is provided with a suction slot 10 extending parallel to the wedge-shaped gap 3 and facing the gap 3. This suction slot is bordered by guiding protrusions extending close to the interior cylindrical surface of the roller 1. By means of the suction pipe 5 and the suction slot 10, there is created an air flow through the perforations of the rollers 1 by means of which the forming yarn 4 is held in the wedge-shaped gap 3 formed by the rollers 1 and 2.

Figure 1:
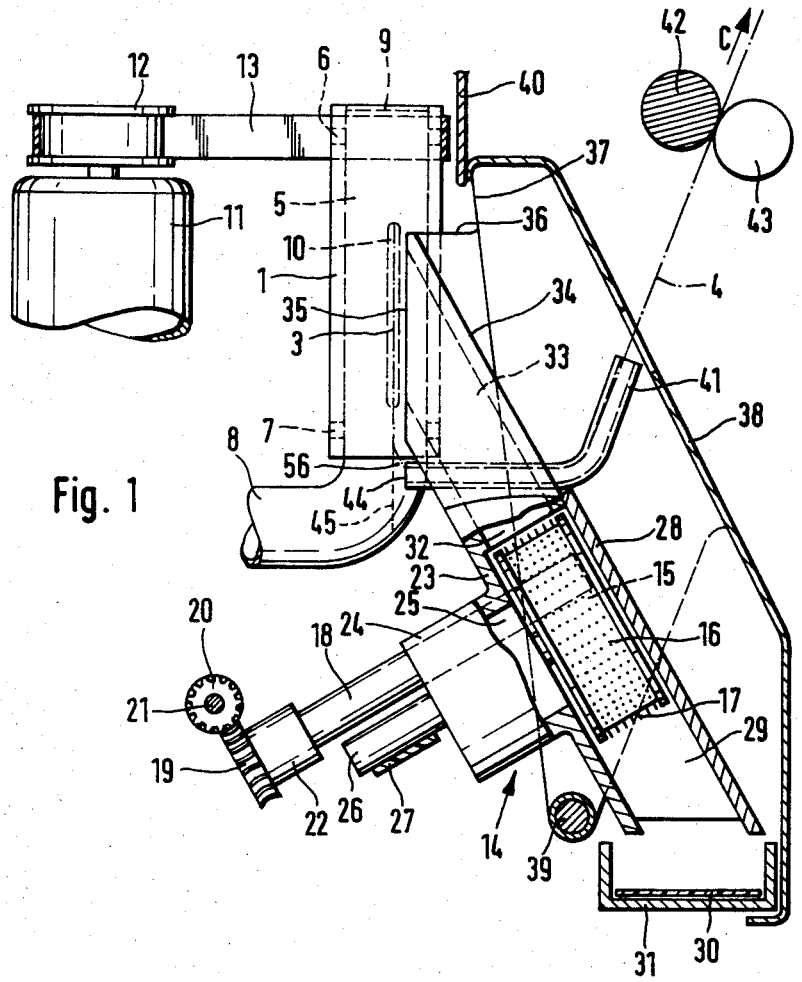
FIG. 1 shows a partial sectional side view of an apparatus in accordance with the present invention for open end friction spinning.

The two rollers 1 and 2 are driven in the same rotational direction by means of electric motor 11. As shown in FIG. 1, the electric motor 11 drives a driving disk 12 which in turn drives a drive belt 13 that is wrapped directly around the surface of rollers 1 and 2. The driving belt 13 extends around the rollers in the region of the upper roller bearing 6 so that deformation of the roller surface is avoided. The electric motor 11 is movably disposed in a manner not further illustrated, and is biased by means of spring elements in a direction opposite the rollers 1 and 2 so that the spring serves as a tensioning device for the driving belt 13.

Underneath the rollers 1 and 2 somewhat offset and at the servicing side of the apparatus, there is arranged an inlet and opening device 14. By means of this device 14 a fiber band (not illustrated) is guided in and opened up into individual fibers which are then guided to the wedge-shaped gap 3. The inlet and opening device 14 includes an inlet roller 15 which works together with an inlet drum and inlet table (in a manner not further illustrated) to offer the fiber band in the form of a fiber beard to a faster running opening roller 16. The opening roller 16 is provided at its circumference with a fitting 17 through which the fiber beard is combed out and opened into individual fibers. The inlet roller 15 is mounted on a shaft (in a manner not further illustrated) and held in a stationary manner at pipe 18. The end of the shaft of the inlet roller 15 extends out of the pipe 18 and is coupled with a gear 19 by means of electromagnetic clutch 22. The gear 19 is meshed with gear 20, which is arranged on a shaft 21. The shaft 21 drives in a corresponding manner a plurality of adjacently arranged inlet rollers 15 from the adjacently arranged devices of a common machine. Electromagnetic clutch 22 is connected with a yarn detector (not further illustrated) by means of which the clutch 22 is opened during a yarn break and the inlet roller 15 therewith is stopped independently of the inlet rollers of the neighboring devices.

The opening roller 16 is disposed in an opening roller housing 23, which in turn is held with a cylindrical protrusion on the bearing pipe 18 of the inlet roller 15. The open roller housing 23 is further provided with a protrusion 24 in which the bearing housing of the axle 26 of the opening roller 16 is disposed. The axle 26 of the opening roller 16 extends out of this protrusion 24 and is driven by means of tangential belt 27. Belt 27 drives the opening roller 16 of the neighboring devices in a corresponding manner. The opening roller 16 at the servicing side of the device is covered with removeable cover 28 for opening roller housing 23.

The opening roller housing 23 is provided at the bottom side with a dirt removal opening 29 by means of which dirt particles and fiber material can be removed. The dirt particles fall out below the inlet of opening device 14 onto a dirt transport belt 30 which runs in a U-shaped trough 31. The dirt transport belt 30 extends along several adjacently arranged devices.

A first part 32 of the fiber feed channel begins somewhat tangentially to the circumference of the opening roller 16 and extends in the opening roller housing 23. This first part is connected with a second part 33 in a further housing 34. The part 33 opens with a slot shaped opening or mouth 35 in the region of the wedge-shaped gap 3. The mouth 35 extends in the direction of the wedge-shaped gap at a close distance therefrom. The shaft of the inlet roller 15 and the axle 26 of the opening roller 16 are arranged with an inclination to the horizontal so that the fiber feed channel formed by the two parts 32 and 33 extends from below the wedge-shaped gap 3 at a sharp angle thereto. The housing part 34 is fastened by means of connecting ribs 36 and protrusions 37 to a cover 38 which extends respectively over the location of each device. The cover 38 is pivotable about a shaft 39 disposed below the inlet and opening device 14. The shaft 39 extends horizontally and transversely to the shafts of the rollers 1 and 2. The covering 38 together with the housing 34 can be pivoted in such a manner as to accommodate servicing of the rollers 1 and 2 by disposing the wedge-shaped gap 3. Thereupon, the inlet and opening device 14 is also substantially exposed. The operating position of the cover 38 of housing 34, which is shown in FIG. 1, is secured by means of abutment 40. The cover 38 is locked or held in an operating position (in a manner not further illustrated) in this way.

The withdrawal of spun yarn 4 is accomplished by means of a withdrawal device which is arranged above the end face of the rollers 1 and 2 and somewhat offset therefrom at the servicing side of the apparatus. The withdrawal device comprises a driven withdrawal roller 42 extending along several adjacently arranged devices and a spring loaded pressure roller 43 at each of the respective devices. The yarn extends from the withdrawal device 42, 43 in the direction of the arrow C to a winding device (not further illustrated), at which the yarn 4 is wound onto a spool. The withdrawal of the yarn 4 takes place first in the region of roller 2 of the wedge-shaped gap 3 diagonally relative to the feeding direction of the fiber feed channel formed of the parts 32 and 33. For this purpose there is a yarn guide 41 provided underneath the rollers 1 and 2. The inlet opening 44 is disposed in the region of the dotted extension 45 of the wedge-shaped gap 3. Guide 41 exhibits a curve extending toward the roller pair 42, 43 forming the withdrawal device. The withdrawn yarn 4 is thereby pulled downwardly in a region 56 out of the wedge-shaped gap 3 formed by the rollers 1 and 2 and turned about 90°. The inlet direction of the fibers and the withdrawal direction of the withdrawn yarn cross each other as can be seen in the side view of FIG. 1. The yarn guide 41 defines a turning location 56 in the region of the inlet opening 44 which operates to block twisting with respect to the wedge-shaped gap 3. In this manner, spinning twist is limited in the region between wedge-shaped gap 3 and the inlet opening 44. Advantageously it is thereby provided that the yarn guide pipe 41 is adjustably arranged in the direction of the extension 45.

Figure 5:
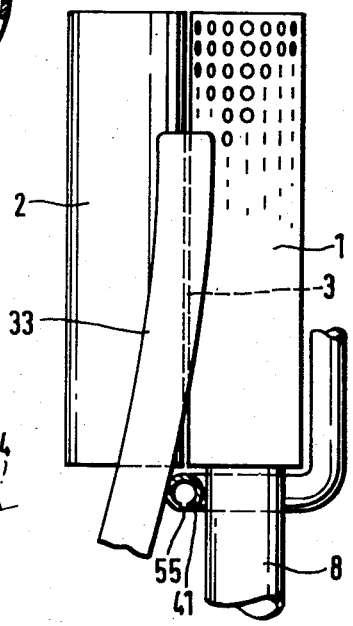
FIG. 5 is schematic view of two rollers taken in the direction of the plane of the wedge-shaped gap.

As can be seen from FIG. 5 the part 33 of the fiber feed channel as well as the yarn guide 41 can be so constructed in the region under the rollers 1 and 2 that they do not hinder one another respectively. The part 33 of the fiber feed channel is disposed with a slight curve at the plane of the wedge-shaped gap (i.e. with respect to the plane extending through the wedge-shaped gap 3 perpendicular to the plane passing through the shafts of the two rollers 1 and 2. The yarn guide 41 begins underneath the rollers 1 and 2 in approximately the wedge-shaped gap plane and then extends outwardly therefrom as illustrated in dash lines in FIG. 5. Thereby it is possible to either fasten the yarn guide 41 at the housing 34 (FIG. 1) or the spinning unit (for example, at the opening roller housing 23). In order to facilitate the insertion of the yarn in the yarn guide 41 after a yarn break, it is provided, according to the embodiment of FIG. 5, that the yarn guide 41 exhibits a slot 55 over its entire length. The slot 55 is disposed at the side at which the yarn 4 normally does not abut when yarn is being withdrawn.

Figure 3:
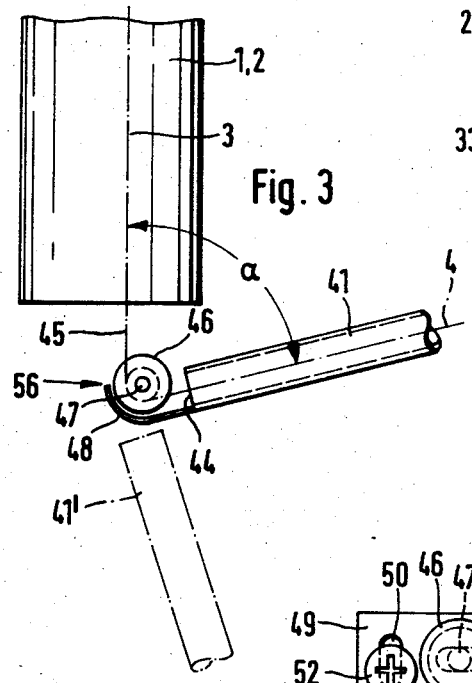
FIG. 3 is a schematic illustration of a detail of FIG. 1 with a turning roller serving as the turning position.

With the embodiment according to FIG. 3, a first turning point for the yarn coming out of the wedge-shaped gap 3 is designed as a turning roller 46 arranged at turning position 56 for the yarn 4 at the extension 45. This turning roller 46 is provided with a guiding groove for the yarn and is arranged on shaft 47. It can be arranged to be freely rotatable or also driven. It can alternatively be non-rotatably disposed or it can be substituted by a corresponding bolt. This turning roller 46 also forms a twist brake for the yarn. The yarn guide 41 is arranged adjacent the turning roller 46. Roller 46, in the embodiment form according to FIG. 3, forms an angle of less than 90° with respect to the wedge-shaped gap 3. Through the use of a turning roller 46, great freedom with respect to the connecting yarn withdrawal direction is achieved. For example, it becomes possible to shift the axle 47 of the turning roller 46 from a position perpendicular to the wedge-shaped gap plane so as to arrange for the yarn 4 to be let off diagonally to the wedge-shaped gap plane. As illustrated in the embodiment according to FIG. 3, a partly surrounding covering 48 is connected at the inlet opening 44 of the yarn guide 41 adjacent the circumference of the turn roller 46. As illustrated in dash lines in FIG. 3, the yarn guide tube 41 can be rotatably disposed on the shaft 47 of the turning roller 46 so that it is pivotable to a position 41′ which essentially extends in the direction of the extension 45 of the wedge-shaped gap 3. In this case the covering 48 is removed. The position 41′ can be especially advantageous when used with an automatic return guide for a yarn end after a yarn break. It will serve as a threading or connecting position for a start spinning operation. It is further possible through the pivotability of the yarn guide 41 to change the angle between the yarn guide 41 and the wedge-shaped gap 3 in response to the spinning conditions so that the effect of the turning roller 46 on twist blocking can be controlled.

Figure 4:
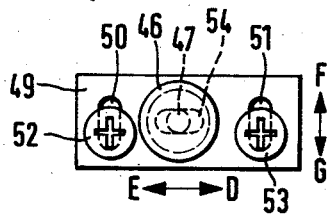
FIG. 4 shows a holder for the adjustable fastening of a yarn guide channel and a turning roller.

A holder 49 is illustrated in FIG. 4 with which the yarn guide 41 and the turning roller 46 is attached to the movable housing part 34 or at a stationary part (in a manner not further illustrated). The holder 49 is fastened with fastening screws 52 and 53 extending through oblong holes 50 and 51, which are arranged parallel to the wedge-shaped gap 3. Thereby it is possible to adjust the position of the holder 49 in the direction of the arrows F and G (i.e. in the direction of the extension 45 of the wedge-shaped gap 3.) The shaft 47 of the turning roller 46 is disposed in a transversely extending guide 54 so that the turning roller 46 can be adjusted and fixed in the direction of the arrows E and D transversely to the extension 45 of the wedge-shaped gap 3.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. An open-end friction spinning apparatus having friction surface means defining a yarn formation zone, inlet and opening means for processing fiber material to be spun and withdrawal means for withdrawing spun yarn comprising:

said friction surface means, having a first end and a second end, said inlet and opening means being disposed at said first end of said friction surface means for feeding fiber material toward said second end, and said withdrawal means being disposed at said second end of said friction surface means for withdrawing the yarn toward said first end, and yarn guide means for guiding the yarn from said first end of the friction surface means toward said withdrawal means.

2. An apparatus according to claim 1, wherein said friction surface means is aligned essentially vertical.

3. An apparatus according to claim 2, wherein fiber feed channel means extend from said inlet and opening means to said yarn formation zone.

4. An apparatus according to claim 3, wherein said yarn formation zone is disposed at a servicing side of said apparatus, and wherein said yarn formation zone is covered by removal housing means.

5. An apparatus according to claim 4, wherein said removal housing means comprises at least a portion of said fiber feed channel means.

6. An apparatus according to claim 2, wherein said yarn guide means comprises roller means.

7. An apparatus according to claim 6, wherein said roller means includes a guide groove for receiving yarn.

8. An apparatus according to claim 6, wherein said yarn guide means comprises yarn guide channel means adjacent said roller means.

9. An apparatus according to claim 8, wherein said yarn guide channel means is adjustably disposed relative to said yarn formation zone.

10. An apparatus according to claim 9, wherein said roller means is rotatable about shaft means, said yarn guide channel means being rotatably disposed about said shaft means.

11. An apparatus according to claim 6, wherein said roller means and said yarn guide means are disposed in a stationary manner relative to said friction surface means.

12. An apparatus according to claim 6, wherein said roller means and said yarn guide channel means are disposed on a removable housing means.

13. An apparatus according to claim 2 wherein said friction surface means comprises a pair of adjacently arranged friction rollers and said yarn formation zone comprises a wedge-shaped gap between said friction rollers.

14. An apparatus according to claim 13, wnerein eacn said friction roller means has an axis of rotation, both said axes being contained in a first plane, and wherein a second plane extends between said rollers perpendicularly to said first plane, said yarn guide means being adjustably arranged adjacent said second plane.

15. An apparatus according to claim 14, wnerein fiber feed channel means extend from said inlet and opening means to said wedge-shaped gap, and said yarn guide means comprises yarn guide channel means, said fiber feed cnannel means and said yarn guide channel means being disposed adjacent said wedge-shaped gap, said fiber feed channel means and said yarn guide channel means being arranged in separate planes, said separate planes being divergent from said second plane.

16. An apparatus according to claim 2, wherein said yarn guide means comprises guide tube means having a longitudinally extending threading slot.

17. An apparatus according to claim 1, wherein fiber feed channel means extend from said inlet and opening means to said yarn formation zone.

18. An apparatus according to claim 17, wherein said yarn formation zone is disposed at a servicing side of said apparatus, and wherein said yarn formation zone is covered by removal housing means.

19. An apparatus according to claim 18, wherein said removal housing means comprises at least a portion of said fiber feed channel means.

20. An apparatus according to claim 1, wherein said yarn guide means comprises roller means.

21. An apparatus according to claim 20, wherein said roller means includes a guide groove for receiving yarn.

22. An apparatus according to claim 20, wherein said yarn guide means comprises yarn guide channel means adjacent said rollers means.

23. An apparatus according to claim 22, wherein said yarn guide channel means is adjustably disposed relative to said yarn formation zone.

24. An apparatus according to claim 23, wherein said roller means is rotatable about shaft means, said yarn guide channel means being rotatably disposed about said shaft means.

25. An apparatus according to claim 20, wherein said roller means and said yarn guide means are disposed in a stationary manner relative to said friction surface means.

26. An apparatus according to claim 20, wherein said roller means and said yarn guide channel means are disposed on a removable housing means.

27. A method of manufacturing an open end friction spinning apparatus comprising:

arranging friction surface means defining a yarn formation zone on said apparatus, said friction surface means having a first end and a second end, arranging fiber inlet and opening means at said first end of said friction surface means for feeding fiber material toward said second end, arranging yarn withdrawal means at said second end of said friction surface means for withdrawing the yarn toward said first end, and arranging yarn guide means adjacent said friction surface means for guiding spun yarn from said friction means to said withdrawal means.

28. A method according to claim 27, wherein said arranging of the friction surface means includes aligning the friction surface means essentially vertical.

29. A method according to claim 28, wherein said friction surface means comprises a pair of adjacently arranged friction rollers defining a yarn-forming wedge-shaped gap.

30. A method according to claim 29, comprising arranging fiber feed channel means between said inlet and opening means and said wedge-shaped gap.

* * * * *